United States Patent [19]

Wittbrodt et al.

[11] Patent Number: 4,893,680

[45] Date of Patent: Jan. 16, 1990

[54] FIRE SUPPRESSION ACTIVATOR

[75] Inventors: Donald R. Wittbrodt, Ft. Mill, S.C.; Wilbert Simkovitz, Southfield, Mich.

[73] Assignee: The United States of America as represented by the Secretary of the Army, Washington, D.C.

[21] Appl. No.: 258,948

[22] Filed: Oct. 17, 1988

[51] Int. Cl.[4] ..... A62C 37/18

[52] U.S. Cl. ..... 169/60; 169/61; 169/62; 169/DIG. 3; 169/56; 169/19

[58] Field of Search ..... 169/60–62, 169/DIG. 3, 19, 26, 56, 11, 59; 340/289, 292, 577, 652; 261/86, 88; 307/130

[56] References Cited

U.S. PATENT DOCUMENTS

| | | | |
|---|---|---|---|
| 3,139,143 | 6/1964 | Renda | 169/19 |
| 3,156,908 | 11/1964 | Kopan et al. | 169/61 |
| 3,993,138 | 11/1976 | Stevens et al. | 169/61 |
| 4,023,153 | 5/1977 | Adachi | 340/652 |
| 4,234,873 | 11/1980 | Warnod | 340/292 |
| 4,270,613 | 6/1981 | Spector et al. | 169/61 |

*Primary Examiner*—Joseph F. Peters, Jr.
*Assistant Examiner*—Anne Sartelle
*Attorney, Agent, or Firm*—Peter A. Taucher; Gail S. Soderling

[57] ABSTRACT

An improved fire suppression system control. The control system has circuitry which reacts to a break in the circuit caused by catastrophic events in a rapid fashion.

2 Claims, 1 Drawing Sheet

FIRE SUPPRESSION ACTIVATOR

GOVERNMENT INTEREST

The invention described herein may be manufactured, used, and licensed by or for the Government for governmental purposes without payment to us of any royalty thereon.

BACKGROUND OF THE INVENTION

1. Field of The Invention

In one aspect this invention relates to fire control systems. More particularly, this invention relates to the activation systems used to start and control the flow of fire extinguishant from a fire control system. In yet a further aspect this invention relates to a control system which will activate the extinguisher when the sensor which normally is used to activate the system is suddenly severed from the rest of the system.

2. Description of the Art

The modern battlefield presents a complex interplay between increasingly sophisticated armor and the antiarmor rounds designed to defeat the armor. No where is this interplay more pronounced than in the armored vehicles. The penetration of an antiarmor round into the interior passenger or engine compartment of the armored vehicle can rupture a fuel cell or other explosive material and will cause a fire which will quickly destroy the personnel and the vehicle. The fear of being trapped inside the burning vehicle is a great deterrent to crew effectiveness. The violent threat represents a significant psychological barrier to effective crew performance. It is therefore imperative to have a fire suppression system on board the vehicle which can react promptly to the incursion of a projectile which causes or can cause a fire. It is also important to limit the amount of damage done to a vehicle when hit in order to reduce the damage done to the expensive vehicles thereby minimizing the loss of material in combat conditions.

Systems for surpressing a fire in the passenger and engine compartments generally comprise a supply of halogenated hydrocarbon such as bromotrifluoromethane, commonly known as Halon-1301, under pressure (e.g. 750 psi) which is contained in one or more bottles in the passenger compartment or other vehicle area sought to be protected. The bottles are connected to a plurality of nozzles which are placed to deliver the Halon to, various parts of the compartment being protected. The connection between bottles and nozzles being within the skill of the art will not be discussed in detail. One or more sensors are placed within the cabin being protected to sense the presence of the type of fire to be surpressed. The sensors are chosen to be sensitive to the radiation given off by fires and are generally placed with overlapping coverage so no volume of the compartment is left unmonitored. In response to a fire the sensors will generate a signal which will go to a centralized control unit and the control unit will activate the system to release Halon to the areas which are on fire. The pressurized bottles of Halon are equipped with fast acting valves which are activated by the control unit and which allow rapid release of the Halon when needed. In a combat situation, it is a goal that the Halon be dispensed into the fire within 100 milliseconds after the onset of the fire. The systems installed in combat vehicles act automatically and without human intervention because of the speed with which the fire extinguishant must be dispensed. There are many different types of halogenated hydrocarbon supply systems available which can be mounted on or in an armored vehicle. These systems have sufficient fire arresting power to stop most fires promptly. Of course, it is necessary that the fluorocarbon be dispensed promptly when a threat in the passenger compartment is sensed.

Various sensing systems have been proposed to signal the presence of a fire in the passenger compartment and send a signal to the remainder of the system to start the flow of extinguishing fluid. Such sensors have been developed to a high degree and provide very fast response. Armored vehicles are subject to catastrophic failure modes when they are struck by such rounds and there exists a real possibility that the sensing system will be damaged. A damaged system which fails to extinguish a fire represents a real hazard.

It is an object of the invention to provide a system where the destruction of the sensing circuitry which would normally trigger the system will itself trigger the system to prevent the destruction of the vehicle and its personnel.

SUMMARY OF THE INVENTION

The present invention relates to a fire extinguishing system which has a source of pressurized fluorocarbon suitable for extinguishing a fire in the interior of an armored vehicle. The system has at least one sensor for detecting a fire to be extinguished. The sensor will generate a signal which signals the presence of a fire and activates the extinguisher system. The fluid connections between the bottle of fluorocarbon and the nozzles used to disperse the fluorocarbon into the vehicle are not described in detail since these elements are well known in the art. It is the improvement of this invention to provide a monitoring system which constantly checks the status of the system and if a catastrophic failure of the sensing system which normally monitors and activates the extinguisher occurs, then the monitoring system will activate the extinguisher to protect the crew.

DETAILED DESCRIPTION OF THE PREFERRED EMBODIMENTS

Figure 1:
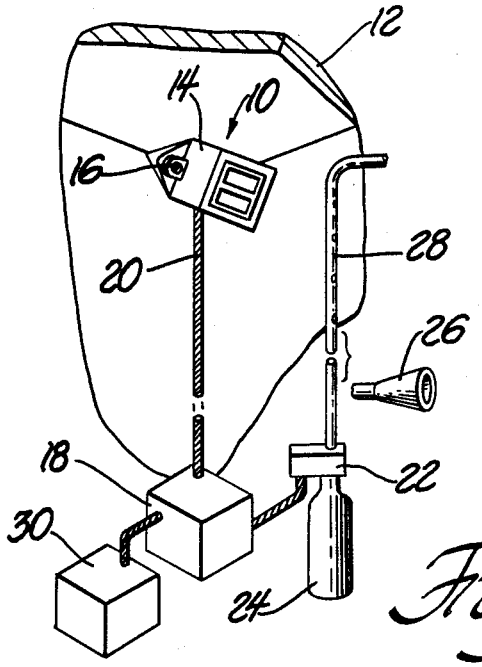
FIG. 1 is a generalized system for fire suppression.

Referring to the accompanying drawing and initially to FIG. 1., one embodiment of a fire suppressing system 10 is shown mounted within the compartment wall 12 of an armored vehicle (not shown). A sensor 14 shown mounted to the wall 12 by means of a fastener 16, is suitable for sensing the types of fires which are likely to be encountered. The sensor in an armored vehicle will sense a flame which is a high temperature fire which requires immediate action. The detector 14 will generally be positioned to scan a particular volume in the compartment of the vehicle being protected. Because the vehicle's compartment is generally irregular in configuration, a plurality of sensors with overlapping coverage patterns will normally be disposed throughout the compartment. When a fire is detected, the sensor 14 will transmit a control signal to a control amplifier 18 or other control means via an electrical connection 20. In response to the control signal, the control amplifier 18 will activate a valve 22 on a Halon bottle 24 to release extinguishant directly into a nozzle 26 or the extinguishant may be released into a line 28 which will carry the extinguishant to one or more nozzles 26. A source of power 30 is shown connected to the control amplifier 18 to provide power to operate the system.

In general the systems using the circuitry of this invention will have one or more bottles 24 containing the pressurized halogenated hydrocarbon. The preferred fire extinguishant is the halogenated hydrocarbon Halon 1301 (bromotrifluoromethane); the normal pressurizing agent is nitrogen which is both inert and inexpensive. Generally the desired amount of the extinguishant is inserted into the bottle and the nitrogen added to make a bottle with sufficient pressure to ensure the rapid discharge of Halon when required. The bottles will generally be charged to a pressure of about 700–800 psi at 70° F. During charging, the bottle can be agitated so that the Halon is saturated with nitrogen in order to prevent the nitrogen from dissolving in the Halon later and lowering the pressure in the bottle to unacceptably low levels.

The valve means 22 is associated with the bottle to allow the bottle to be charged and recharged with Halon and to allow the Halon to be rapidly dispensed when a fire is sensed. Various solenoid or explosive activated squib valves have been used in the systems installed in different vehicles. The exact valve structure is not important to the system. In general, the valve will be chosen based on its response time and ability to deliver the extinguishant in the time frame required to save the crew. More specifically, the valve should release the extinguishant in about 100 milliseconds or less when activated without requiring any human intervention.

The extinguishant will be discharged through the nozzle 26 toward the fire sensed by the sensing means chosen. Many sensing systems have been proposed and developed to send a signal to the valve and activate the valve. The exact structure of the sensing circuitry and design are not relevant since the sensors used will change depending on the type of vehicle and the area being monitored. In all instances, the sensor will normally be set to activate the valve only when a fire of the type caused by an armor piercing round penetrating the vehicle interior or engine is sensed.

Figure 2:
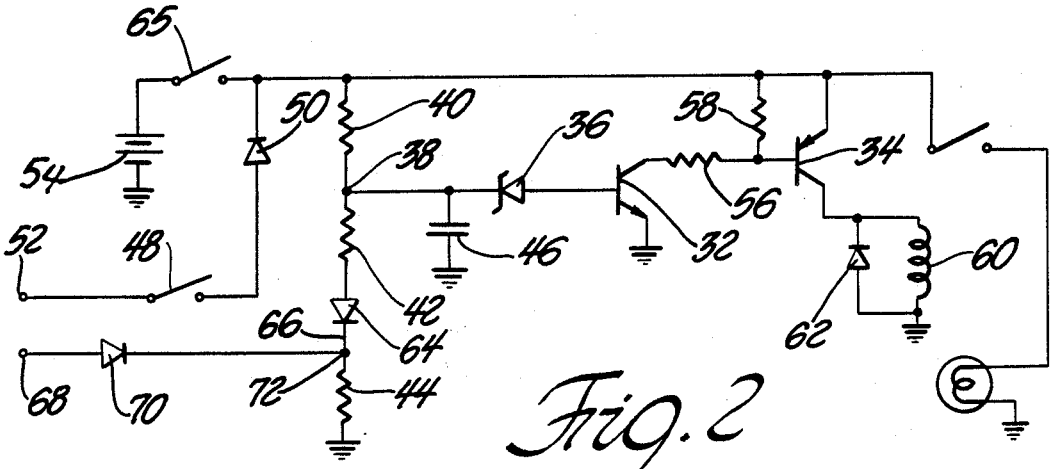
FIG. 2 is schematic on monitoring system of this invention.

One circuit which would function in cooperation with the remaining circuitry of the control amplifier 18 constructed in accordance with this invention is shown in FIG. 2. In this circuit, the transistors 32 and 34 serve as the amplifiers in the circuit. A zener diode 36 serves as a threshold voltage sensor to sense the voltage at a node 38. Three resistances 40, 42 and 44 form a voltage divider. Resistor 40 in combination with a capacitor 46 form an initial suppressing circuit for when the system is first energized with power. A switch 48 and diode 50 form a charging circuit which will allow current from an alternator (not shown) which is part of the vehicle electrical system attached to the circuit at connection 52, to maintain a battery 54 in a fully charged condition. The battery 54 will be charged by the vehicle alternator when ever the vehicle is being used. A resistance 56 is placed between transistors 32 and 34 to limit current flow and a resistance 58 serves as a suppressor resistor for transistor 34. A relay 60 serves as an output device for a solenoid or other valve activating device attached to valve 22. Diode 62 serves as a suppressor diode and diodes 50 and 64 serve as blocking diodes.

When operated, the circuit is activated by closing either of the switches 48 or 65. In the case of switch 48, the power to the circuit will be from the vehicle electrical system, and if switch 65 is closed the circuit power will be from the auxiliary battery 54. In either case, current flows through resistor 40 through the capacitor 46 to ground. The capacitor 46 will charge until the voltage at node 38 and the capacitor is equal to the resistance 40 divided by the sum of the resistances 40+42+44. This voltage will be lower than the voltage at diode 50. This is the quiescent state with a small amount of current passing through a line 66 as long as the system is not activated by the sensor 14 or disturbed by circuit disruption.

When line 66 is severed, such as by being cut by an antiarmor round, there is a discontinuity in current flow through the line. As a consequence, the voltage at node 38 rapidly rises in value and current will flow through the Zener diode 36 to the base emitter junction of transistor 32 which will reach saturation in conjunction with transistor 34 energizing the relay 60. The relay will activate the valve on the fire suppression bottle and allow distribution of the extinguishant.

In the event the sensor 14 detects a fire and sends a signal to the circuit through the connection at contact 68 current will flow through diode 70 and raise the voltage at node 72 above the voltage at node 38 altering the quiescence state. Current through resistance 42 and diode 70 is zero due to the blocking characteristics of diode 64. The voltage will rapidly rise at node 38 and the remainder of the system will activate the relay 60 as described before.

Figure 3:
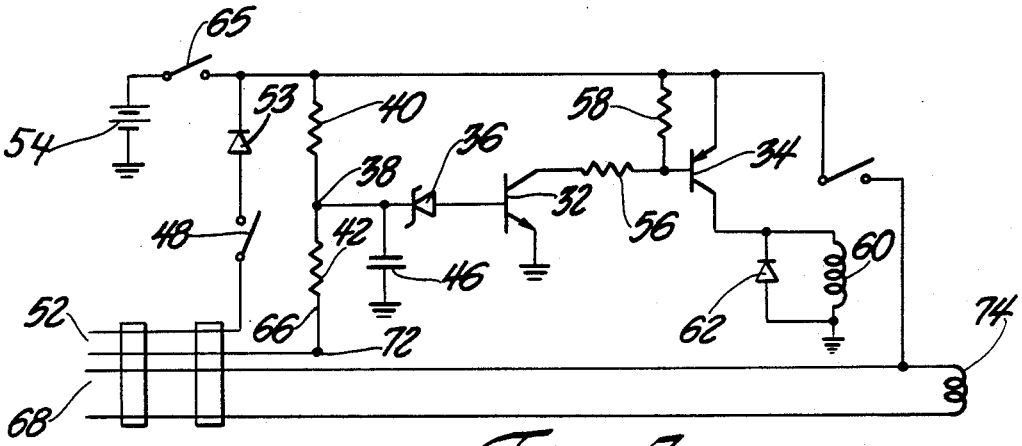
FIG. 3 is schematic of a second monitoring system according to this invention.

A second circuit is shown in FIG. 3. In this configuration, closing either switch 48 or switch 65 will energize the system as described before. When the line 66 is severed the system operates to activate the coil 60 and open the valve. In this alternative embodiment, a signal from sensor 14 will pass through the amplifier 18 and directly activate the solenoid 74 instead of having the fail safe circuit be an integral part of the circuit.

We wish it to be understood that we do not desire to be limited to the exact details of construction shown and described for obvious modifications will occur to a person skilled in the art, without departing from the spirit and scope of the appended claims.

What is claimed is:

1. A fire suppression control system for use with a vehicle subject to catastrophic incidents the fire suppression system containing at least one pressurized container of halogenated material suitable for suppressing a fire, a distribution system for distributing the halogenated material to the situs of a fire within the vehicle, a valve disposed between the bottle and the distribution system to maintain the halogenated material in the bottle until needed and adapted to open rapidly when the fire suppression material is needed, a fire sensor which will sense the presence of a fire which will require the dispensing of the fire suppressing material and generate a signal that action is necessary, a control amplifier adapted to receive the signal from the sensor and in response to the signal activate the system by opening the valve, a source of power to provide power to operate the system, the improvement comprising an amplifier circuit having an amplifier maintained at a nominal voltage in the quiescent state, a circuit portion adapted to maintain the amplifier's nominal voltage, a second circuit element adapted to sense when the electrical connection between the sensor and the amplifier is broken and generate an increased voltage which will activate the valve to dispense extinguishant to the damaged area, a third circuit element which will pass a sensor signal to the amplifier and open the valve when the sensor signals the presence of a fire.

2. A safety circuit for use with a fire suppression apparatus where a valve is attached to a pressurized container of extinguishant, the valve being normally closed and being adapted to open rapidly in response to a sensor signal so that the extinguishant is delivered to the site of a fire, the safety circuit having means for sensing a voltage potential normally present within the circuit in the undisturbed condition, means for generating an activating voltage when the sensed voltage disappears, the activating voltage opening the valve to dispense the extinguishant.

* * * * *